US006186838B1

(12) United States Patent
Foster

(10) Patent No.: US 6,186,838 B1
(45) Date of Patent: Feb. 13, 2001

(54) ELECTRICAL CONNECTION BOX

(76) Inventor: Clair C. Foster, 10065 Hillwood Dr., Wattsburg, PA (US) 16442

( * ) Notice: Under 35 U.S.C. 154(b), the term of this patent shall be extended for 0 days.

(21) Appl. No.: 09/213,048

(22) Filed: Dec. 16, 1998

(51) Int. Cl.[7] ..... H01R 13/46
(52) U.S. Cl. ..... 439/797; 174/59
(58) Field of Search ..... 174/59; 439/797

(56) References Cited

U.S. PATENT DOCUMENTS

| | | | | |
|---|---|---|---|---|
| D. 195,623 | * | 7/1963 | Leonardo | D13/149 |
| 699,483 | * | 5/1902 | Brady | 174/59 |
| 708,692 | * | 9/1902 | Bossert | 174/59 |
| 1,923,939 | * | 8/1933 | Lavarack | 174/59 |
| 2,463,033 | * | 3/1949 | Harnett | 174/59 |
| 2,545,898 | * | 3/1951 | Schmitt | 174/59 |
| 3,450,951 | * | 6/1969 | Boyle | 174/38 |
| 3,732,530 | * | 5/1973 | Linn et al. | 439/798 |
| 3,848,224 | * | 11/1974 | Olivero | 174/59 |
| 4,050,770 | * | 9/1977 | Rigo | 174/59 |
| 5,486,664 | * | 1/1996 | Lamp | 439/135 |

* cited by examiner

*Primary Examiner*—Neil Abrams
(74) *Attorney, Agent, or Firm*—Richard K Thomson

(57) ABSTRACT

A weather head electrical connection box enables electrical connection to a home or business without the need for splicing. The box contains three splice blocks which have two sets of orifices equipped with set screws, a first set for the power feed and the second for the service entrance cable from the customer's building. These connector blocks are of conductive material and transmit power from the in feed to the service entrance cable without the need for splicing. The connection box is provided with a removable cover that may be provided with a pivot finger that engages in a slot secured to the bottom of the box and may be closed by a wire to restrict access to the box. The housing may be alternatively attached to the top of a service pipe that extends above the roof or to the side of a house.

9 Claims, 5 Drawing Sheets

ELECTRICAL CONNECTION BOX

The present invention is directed to an electrical connection box commonly referred to as a "weather head". More particularly, the present invention is directed to a weather head connection box in which power connections can be quickly, easily and reliably made.

BACKGROUND AND SUMMARY OF THE INVENTION

One of the prevailing practices in the housing industry for making electrical connection through a weather head is to unjacket two feet of service entrance cable and run it through the weather head connection box. When the workman from the electric company runs the power feed from the road to the house or business, s/he has to splice the three wires (two positive, and one ground) from the power feed to the local service leads at an approximate cost of $12.00.

The weather head connection box of the present invention proposes to eliminate the need for splicing. The three leads from the service entrance cable wire can be inserted into a first set of orifices in three junction blocks and secured by set screws. When service is brought from the street, the three power feeders can be inserted into three sister orifices in the three junction blocks and secured by a second set of set screws. The three junction blocks are conductive metallic L-shaped blocks, preferably compatible with copper and aluminum, isolated from one another and designed to make reliable connection between the power feeders and the service leads. A cover, which has a pivot arm on the lid which can drop into a slotted arm on the box, protects the junction blocks from weather and can be subsequently sealed by the local utility company using a twist tie wire. The weather head connection box can be provided with two adaptors, one of which will enable the box to be attached to the top of a 2" PVC stack and to a 2–2 ½" galvanized pipe, the two types of stacks prevailing in the industry, and the other adaptor which clamps to a service entrance cable running to the electric meter.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
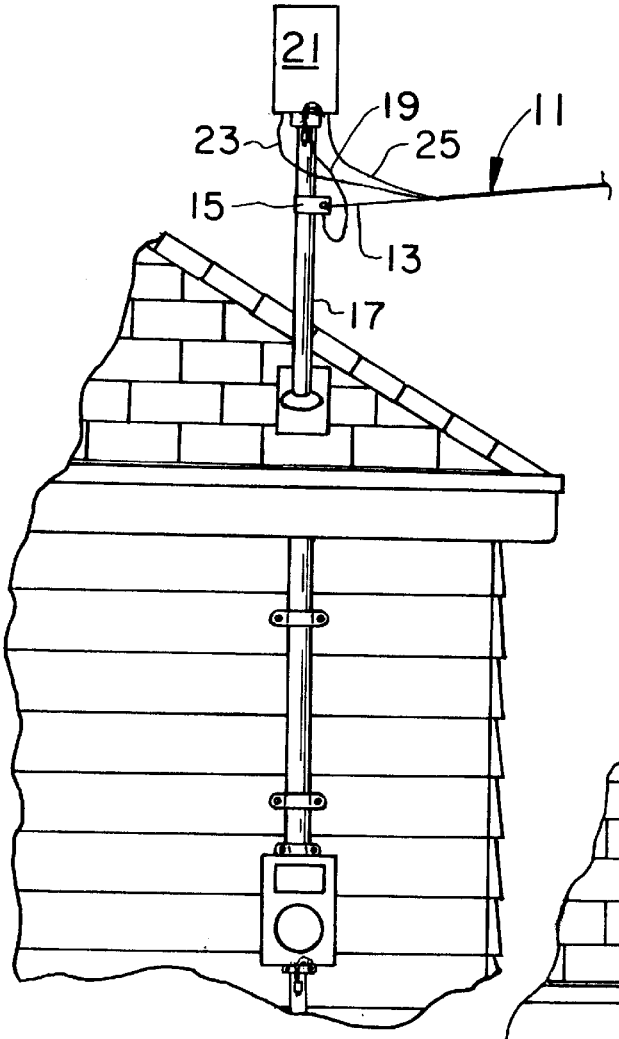
FIG. 1 is a schematic depiction of a first conventional use of the weather head connection box of the present invention.
Figure 2:
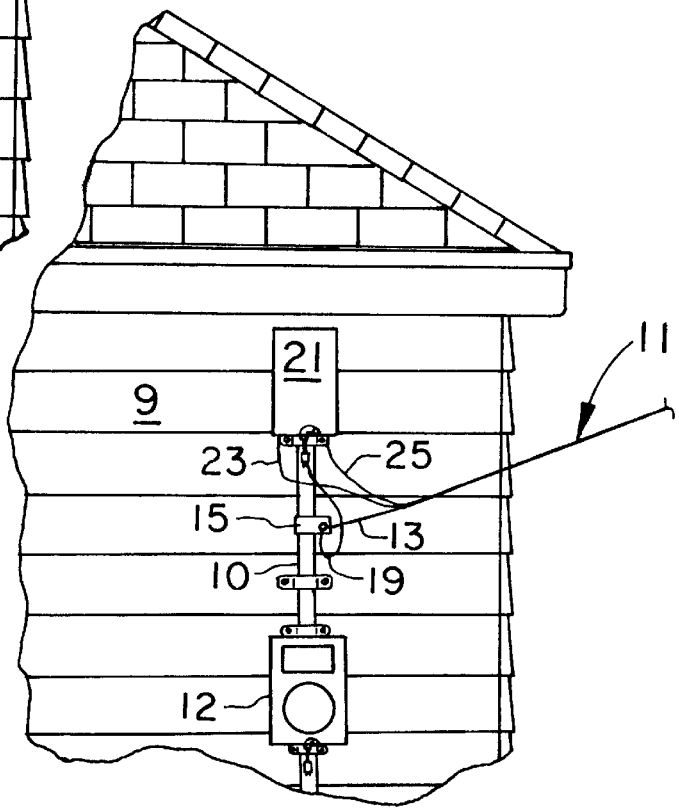
FIG. 2 is a schematic depiction of a second alternative use of the weather head connection box of the present invention.

FIGS. 1 and 2 depict two common ways weather heads are used to make electrical connection to residential and business customers' facilities. In FIG. 1, the ground wire 13 of the power feed 11 from the street is connected to a clevis 15 on service pipe 17. A ground cable 19 is connected inside of weather head box 21, as are the two positive cables 23 and 25. In FIG. 2, weather head connection box 21 is attached to the side of house 9 and service entrance cable 10 connects the power feed 11 from the street to the electric meter 12.

Figure 3:
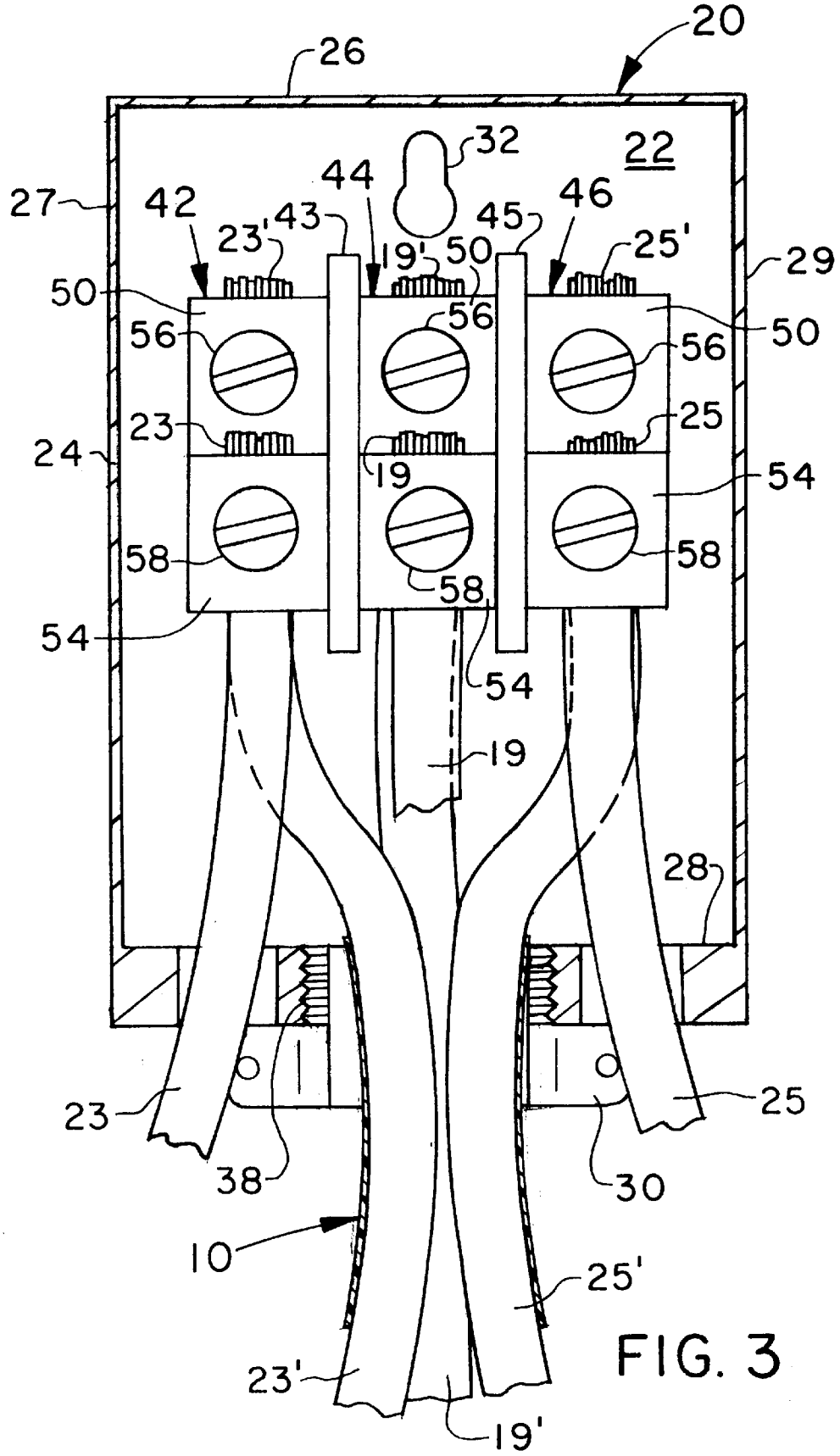
FIG. 3 is a front view of a first embodiment of the weather head connection box of the present invention with the cover removed shown attached to an entrance cable.
Figure 4:
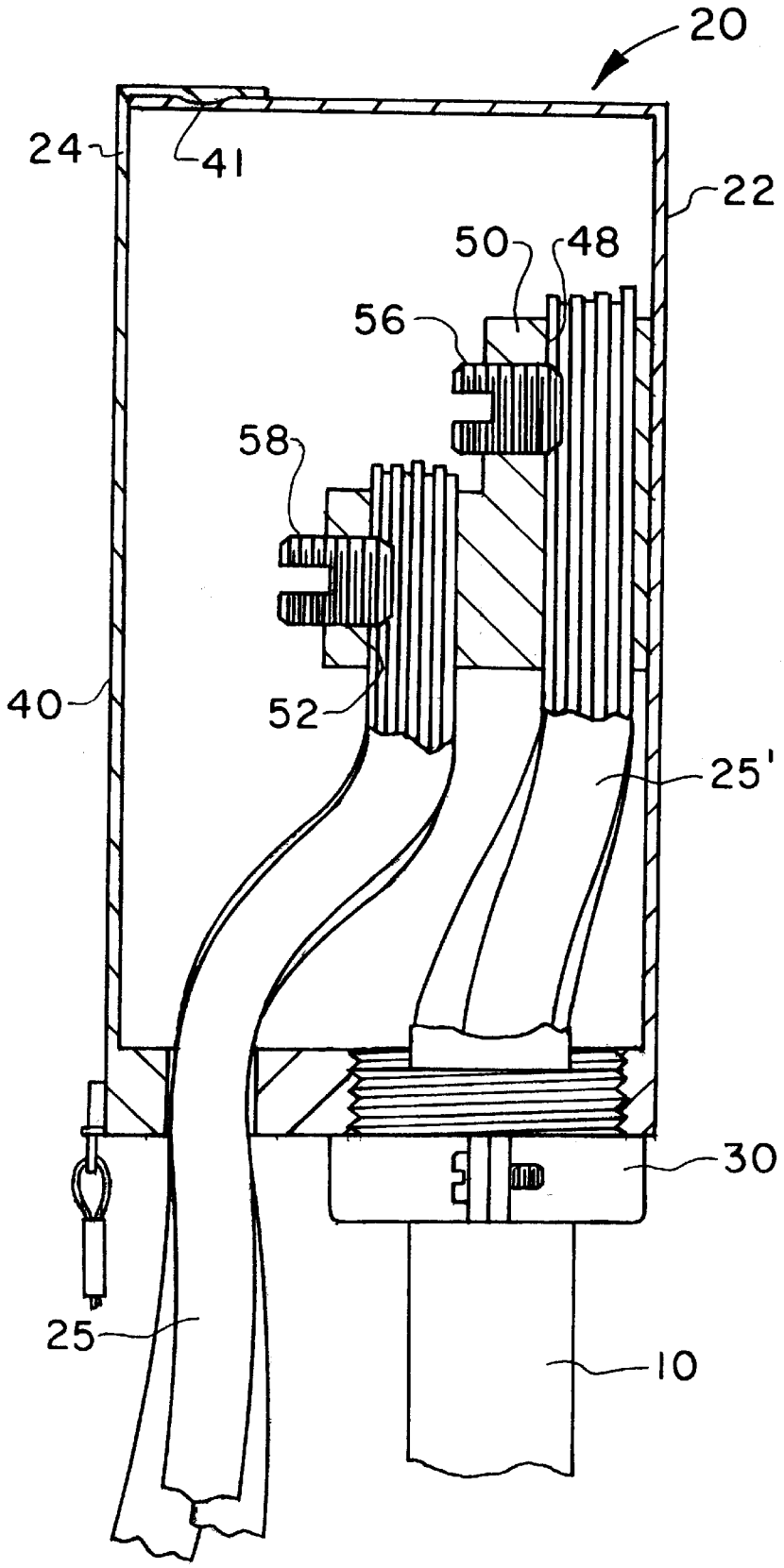
FIG. 4 is a cross-sectional side view of the connection box shown in FIG. 3.
Figure 7:
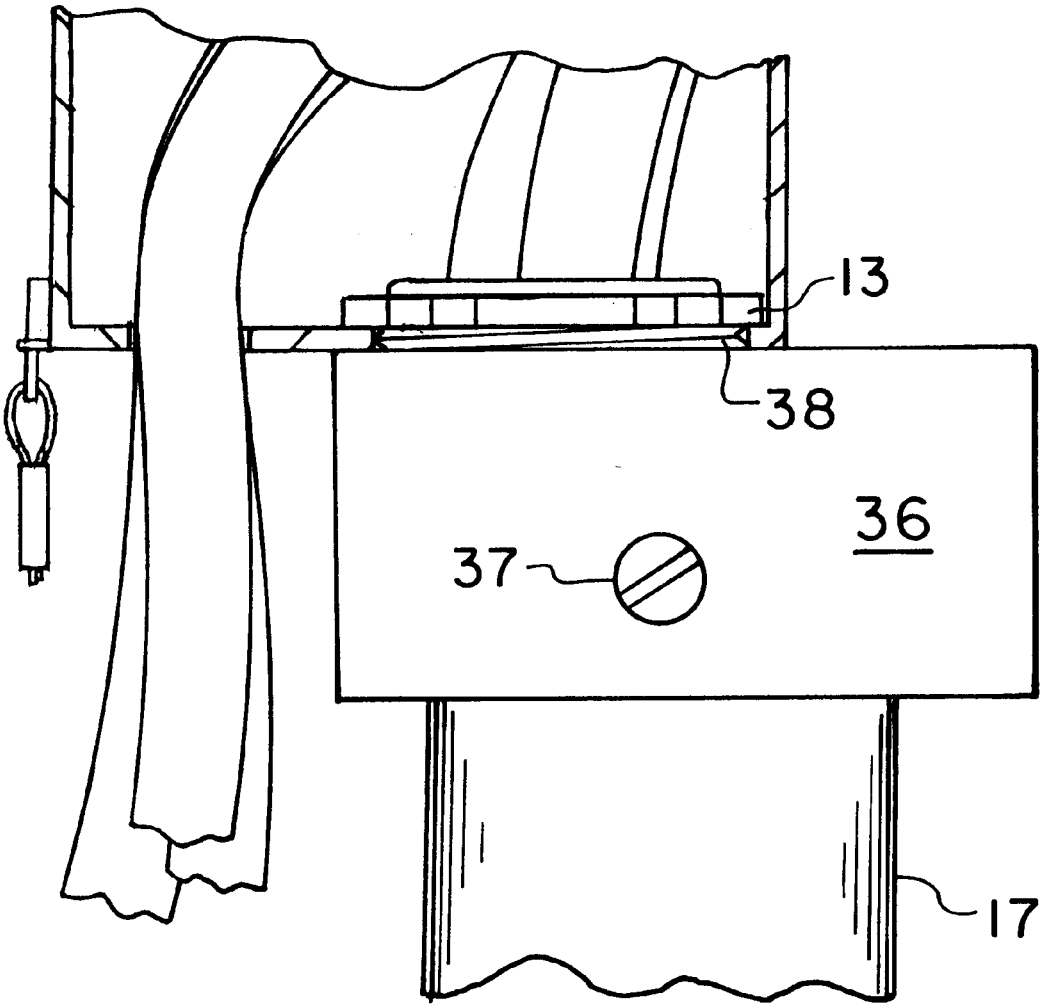
FIG. 7 is a cross-sectional side view similar to FIG. 4 showing the connection box sitting atop a service pipe.

A first preferred embodiment of the weather head connection box of the present invention is shown in FIG. 3 generally at 20. Weather head connection box 20 could be metallic but is more preferably made of a durable plastic material. The box 20 includes generally rectangular housing 20A which is generally C-shaped in cross section with a first back side 22 and an open second front side 24 that can be closed by a removable cover 40 (FIG. 4). Third lateral side 27 and fourth lateral side 29, along with top 26 and bottom 28, complete the enclosure formed by housing 20A. Back side 22 has an elongated opening 32 facilitating attachment to the side of a house, or the like. Such an attachment will be utilized when weather head connection box 20 is connected directly to a service entrance cable 10 (FIG. 4). It should be noted that such attachment is optional; connection box 20 can simply sit atop the service pipe 17 (FIG. 7). Box 20 is coupled to service cable 10 using clamp 30 with its associated threaded collar 38 which threads into a cylindrical opening 34 in bottom 28. Service pipes 17 generally have one of three forms: 2" pvc pipe, 2" galvanized pipe, or 2½" galvanized pipe. Adaptor 36 (FIG. 7) can be provided to facilitate the connection between service pipe 17 and box 20 using a set screw 37 regardless of the size of the pipe. The embodiment shown in FIG. 7 has a thin-walled bottom 28 so rather than thread into it, a simple nut 13 can be threaded on the top 38 of adaptor 36 to secure the box 20 thereto. As an additional alternative, a threaded metal grommet (not shown) could have the thicker bottom 28 molded into it, providing better pull out resistance than the threads in the plastic bottom 28.

Three junction blocks 42, 44, 46 are affixed to the inner surface of first side 22 by an adhesive or using plastic screws. Junction blocks 42, 44, 46 are made of electrically conductive materials that are compatible with both aluminum and copper. Such materials include aluminum, copper and some steels. If connection box 20 is made of metal, a layer of elastomer or insulative foam will be disposed between back side 22 and junction blocks 42, 44, 46. Junction blocks 42, 44, 46 are isolated from one another by positioning a layer of insulative foam 43 between blocks 42 and 44 and another layer 45 between blocks 44 and 46. Junction blocks 42, 44, 46 are identical L-shaped members each with a first orifice 48 extending axially through the long arm 50 of the L and a second orifice 52 extending transversely through the short arm 54. A first set screw 56 is threaded transversely through long arm 50 to extend into first orifice 48 and a second set screw 58 is threaded axially into short arm 54 to extend into second orifice 52.

Connection box 20 is attached to the top of service pipe 17 using adaptor 36 and attachment nut 13, or alternatively, to service cable 10 using clamp 30 with box 20 being threaded onto collar 38. Service entrance cable 10, has two positive wires 23' and 25' and a ground cable 19'. A length of several inches of each of wires 23' and 25' is unjacketed and wire 23' is threaded through orifice 48 in block 42 and secured therein by set screw 56. Similarly, second positive wire 25' and ground 19' are threaded through orifices 48 in blocks 46 and 44, respectively, and secured therein by set screws 56. A pair of protrusions 41 on cover 40 are received in recesses in top 26. A pivot finger 55 on the cover 40 can be engaged in a slot in arm 57 attached to bottom 28 to extend outwardly past open front side 24. A wire 61 can be inserted through a hole 59 in pivot finger 55 so the electric company can restrict access to the box 20 for safety reasons.

Figure 5:
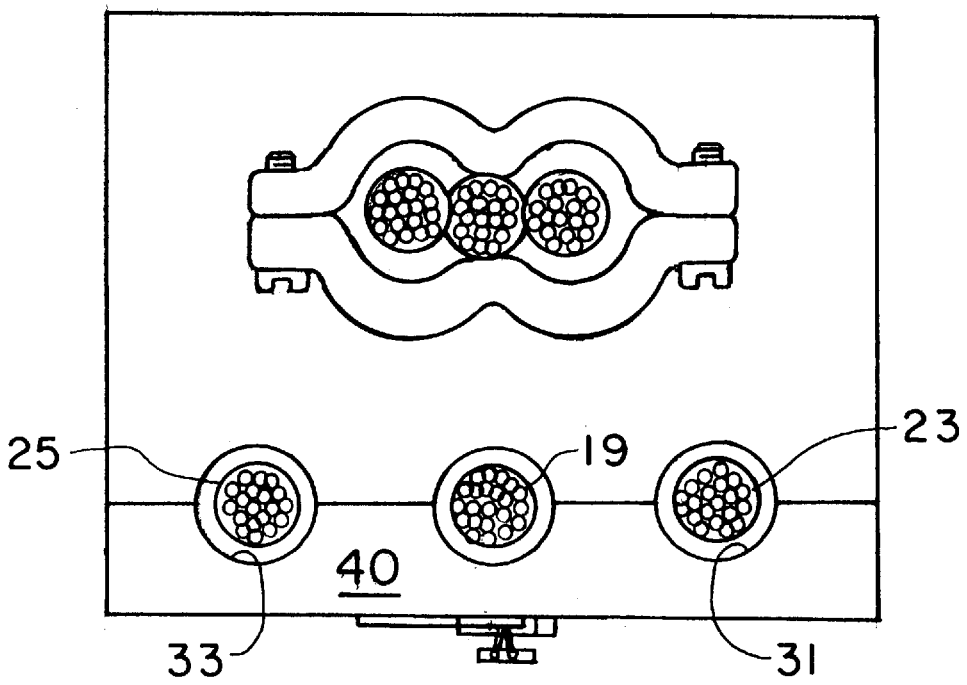
FIG. 5 is a bottom view in partial cross section of the weather head connection box of the present invention.
Figure 6:
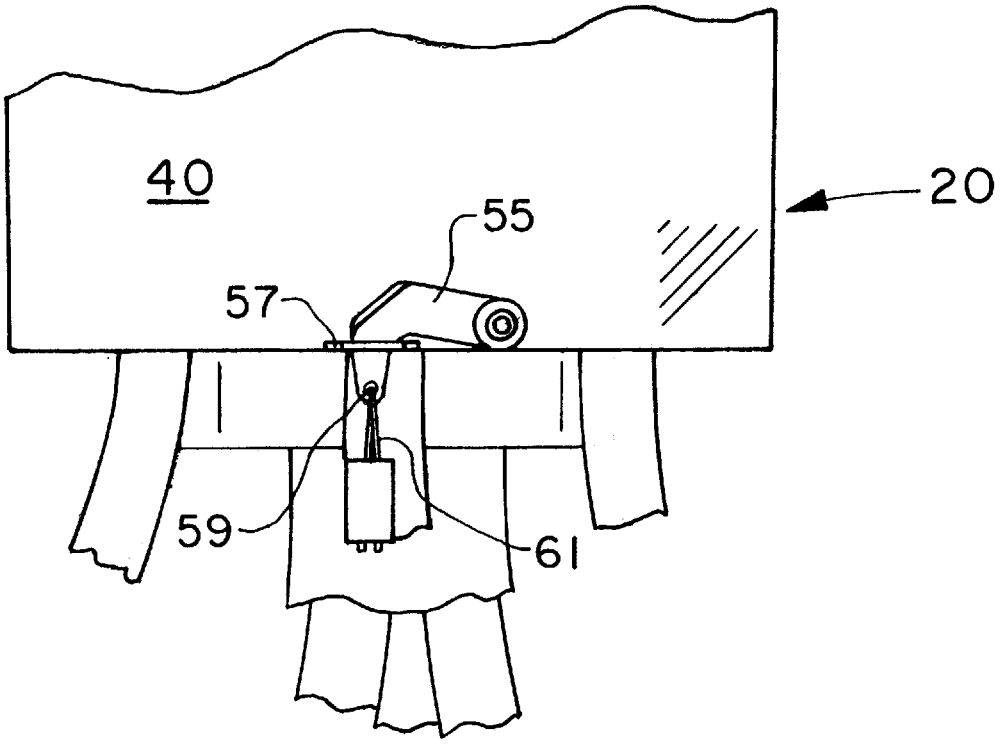
FIG. 6 is a front view of the weather head connection box of the present invention with the cover secured in place.

When construction of the house or place of business is sufficiently complete, the power company's representative can make the electrical service connection by simply removing cover 40, running the power feed including two positive wires 23 and 25 and a ground 19 into the bottom 28 of box 20 through the apertures 31, 33 and 35 (FIG. 5) provided therefore, and threading those wires into orifices 52 in the front portion of blocks 42, 44, 46, respectively, using set screws 58 to secure those wires therein.

The weather head connection box 20 of the present invention enables electrical connection to be more quickly, easily and reliably made than has previously been possible without the need for splicing or unjacketing as much cable as has heretofore been necessary.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. An electrical weather head connection box for connection to an external portion of a residential/commercial customer's establishment and supplying power thereto, said connection box comprising a) a generally rectangular open-front housing having a back wall, two side walls, a top wall and a bottom wall;

b) three L-shaped junction blocks secured within said housing, each L-shaped block having a first orthogonal arm and a second orthogonal arm, each junction block having a first orifice for receiving a service lead from the customer's establishment in said first orthogonal arm and a second orifice for receiving a power feed in said second orthogonal arm, each of said three junction blocks being electrically isolated from said housing and from each other;

c) a cover removably attachable to said housing to close and seal said open front against the elements and thereby protect said junction blocks from exposure;

d) securing means to attach said housing to a service entrance cable, said securing means including means to allow attachment of said weather head connection box to a side of a house and to a service pipe of between 2" and 2 ½", whereby electrical power connection may be quickly and efficiently made by inserting each of three local service leads into said three first orifices and each of three power feeder wires into corresponding ones of said three second orifices.

2. The electrical connection box of claim 1 wherein said housing and said cover are made from a high strength, durable plastic.

3. The electrical connection box of claim 1 wherein said junction blocks are made of an electrically conductive material.

4. The electrical connection box of claim 3 wherein said electrically conductive material is selected from a group consisting of copper and aluminum.

5. The electrical connection box of claim 1 further comprising a pivot finger on said removable cover, said pivot finger being engageable in a slot in an arm which extends outwardly beyond said open front side of said housing to close said housing to protect said junction blocks from exposure.

6. The electrical connection box of claim 5 wherein said pivot finger has a hole which may be secured by a twist tie wire to limit access to said weather head connection box.

7. The electrical connection box of claim 1 wherein said securing means further comprises a nut which fits inside said connection box and is threaded onto a top portion of said adaptor which extends into said connection box, said nut securing said connection box to said adaptor.

8. The electrical connection box of claim 7 wherein said securing means further comprises a set screw secured through said adaptor and engaging said service pipe.

9. The electrical connection box of claim 1 wherein said first orifice extending parallel to a longitudinal direction of said first arm and said second orifice extending transverse to a longitudinal direction of said second arm.

* * * * *